US006146001A

United States Patent [19]

Cwiakala

[11] Patent Number: 6,146,001

[45] Date of Patent: Nov. 14, 2000

[54] BALLOON LUMINARY

[75] Inventor: Martin Cwiakala, Piscataway, N.J.

[73] Assignee: Patrick Alexander, Co., Inc., Piscataway, N.J.

[21] Appl. No.: 09/213,790

[22] Filed: Dec. 17, 1998

[51] Int. Cl.[7] ..... F21V 31/00

[52] U.S. Cl. ..... 362/267; 362/186; 362/253; 362/376; 446/222; 446/485

[58] Field of Search ..... 446/220, 222, 446/485; 362/96, 186, 253, 267, 278, 320, 376

[56] References Cited

U.S. PATENT DOCUMENTS

| | | | |
|---|---|---|---|
| 1,530,923 | 3/1925 | Anns | 362/320 |
| 1,776,182 | 9/1930 | Cook | 446/220 |
| 4,292,999 | 10/1981 | Szollmann | 362/96 |
| 5,119,281 | 6/1992 | Akman | 362/253 |
| 5,141,518 | 8/1992 | Hess et al. | 606/194 |
| 5,499,941 | 3/1996 | Penjuke, Sr. | 446/222 |
| 5,795,211 | 8/1998 | Carignan et al. | 446/220 |

*Primary Examiner*—Alan Cariaso
*Attorney, Agent, or Firm*—Omri M. Behr, Esq.

[57] ABSTRACT

A helium or air filled latex balloon includes a lamp in its interior connected to an external power source by an electrically conductive cable passing through the balloon inlet port and neck. The cable comprises wires encapsulated with Kynar, a polyvinylidene fluoride, a semi-crystalline thermoplastic polymer that exhibits tacky surfaces and excellent properties for providing a weatherproof tight seal between the wire cable and the balloon. The neck is sealed with curling ribbon, by knotting or clips and the like. Air filled balloons may be supported by a stiff music wire or straw and helium filled balloons may be tethered by the cable. A power source illuminates the lamp via the cable.

17 Claims, 1 Drawing Sheet

ON
OFF

BALLOON LUMINARY

This invention relates to balloon luminaries.

Balloons typically are elastomeric inflatable latex rubber membranes that are filled with pressurized air or gas forming a floating globular structure. When filled with air a support typically is employed for holding the balloon aloft. When filled with helium the balloons float due to their buoyancy and being lighter than air. The membranes normally are thin elastonieric films that readily expand under pressure and remain relative gas impervious.

Balloons have a gas inlet port for receiving the pressurized gas. After inflation, the port, which is typically a relatively narrow neck portion, is twisted about itself to form a knot sealing the port. Also, ribbons or cords may be used which are tightly tied about the neck portion to seal the port. Clips also may be used and similar devices.

The present inventor recognizes a need for an illuminated luminary balloon in which a light source is placed within the balloon. The problem recognized with this arrangement is that in order for the balloon to reasonably float in the air, its weight needs to be minimized. While electrical conductors may be provided that are relatively light, power sources such as batteries are relatively heavy and would normally interfere with the floatation of the balloon. It is not always desirable to support a balloon on a stiff enough support to carry the weight of such batteries.

The present inventor also recognizes that to place the batteries or power source externally of the balloon would be most desirable. However, in this case a conductor needs to be passed through the balloon neck to connect the light in the balloon to an external power source. It is further recognized that typical commercially available conductors when passed through the balloon neck slip readily which would interfere with the sealing of the neck regardless which technique is employed.

The present inventor recognizes a need for a balloon which can remain inflated with an external power source coupled to an internal lamp in the balloon and uses wires resistant to slip leak.

A balloon luminary according to the present invention comprisesa n elastomeric inflatable light translucent membrane having a pressurized gas inlet port forming an inflated balloon in response to pressurized gas applied to the membrane through the port into the balloon interior; a lamp within the balloon interior; electrical power means passing through the port for illuminating the lamp; and means for closing the port for entrapping the pressurized gas in the interior.

The means for illuminating in one aspect includes a conductor passing through the port and connected to the lamp.

In a preferred aspect, the conductor comprises a metal wire with an insulating, suitably an adhesive coating for adhering to the wire and to the membrane at the port for sealing the port.

The desirable qualities of the insulating coating is that it is light-weight, has high dielectric constant, provides a good sealing surface, is wear resistant, has pleasant feel, and is food safe. It should also provide sufficient friction to hold the light assembly in place under normal circumstances (walking with balloon in light breeze). One such material is thermoplastic polyvinylidene fluoride (PVDF).

The means for closing the port may comprise a ribbon tied about the port or tying the membrane and conductor passing through the port into a knot about the port.

In a further aspect, a base and an elongated support is attached to base and to the balloon at the port.

The means for illuminating may include an electrical power source in the base selectively coupled to the lamp via the conductor passing through the port.

The gas may be one of air and helium.

Where the gas is air, the support may include a straw connected to a cone, the cone for receiving the balloon at the port.

In a still further aspect, the elongated support is an electrical conductor connected to the lamp and the power means comprises a power source in the base connected to the conductor. Switch means may be in the base for selectively illuminating the lamp. Desirably, a fuse should be provided for each line powering a lamp. The fuse will limit excess current in the event of a short.

IN THE DRAWING

Figures 1, 2, 3, 4, 5, 6, 7, 8:
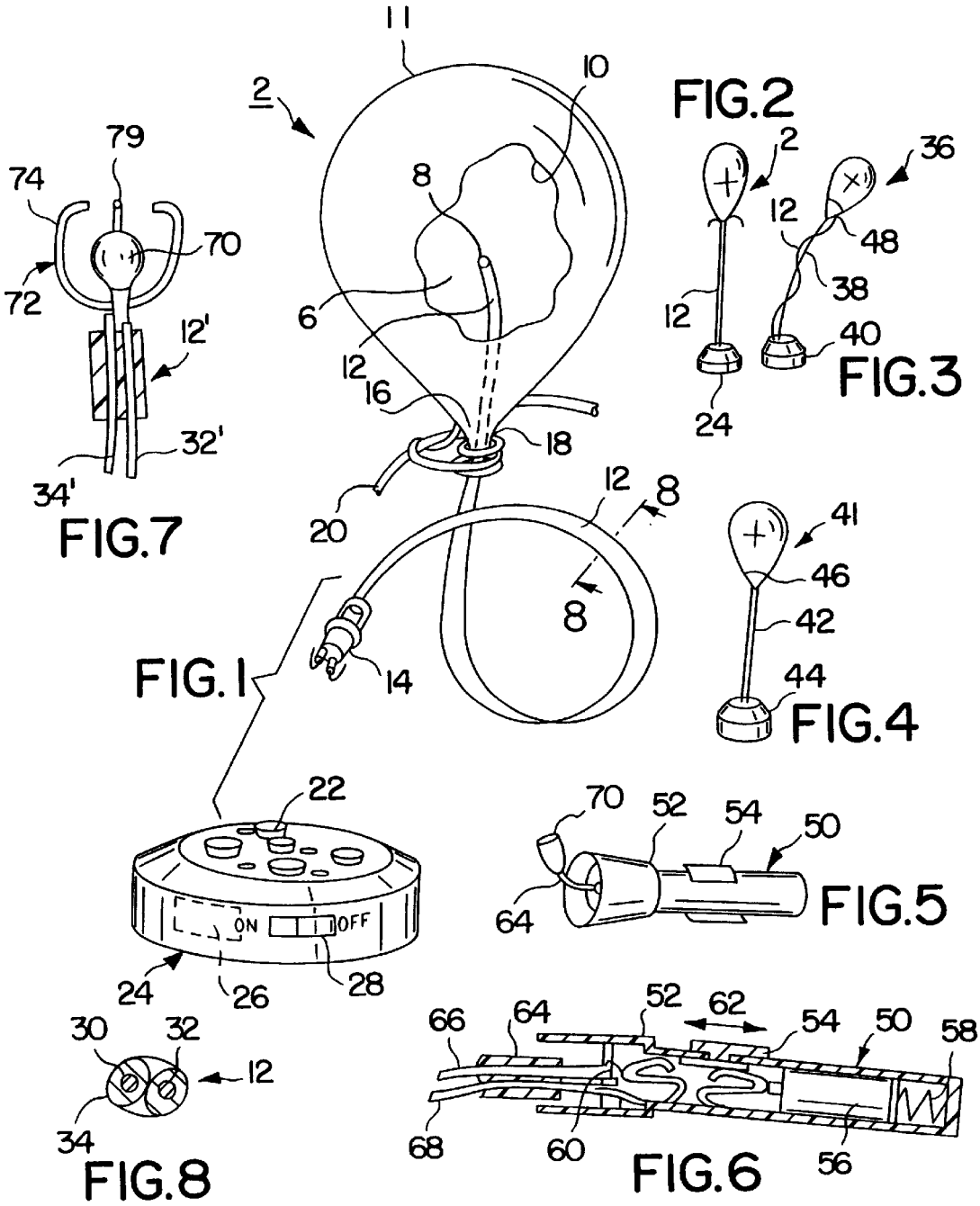
FIG. 1 is an exploded perspective partially in section view of a balloon luminary according to one embodiment of the present invention.
FIGS. 2, 3 and 4 are elevation perspective views of a balloon luminary according to further embodiments of the present invention.
FIG. 5 is a side perspective view of a portable hand held power source for the luminary of the embodiments of FIGS. 1–4.
FIG. 6 is a side elevation sectional view of the embodiment of FIG. 5.
FIG. 7 is a side elevation sectional view of a lamp assembly according to an embodiment of the present invention.
FIG. 8 is a sectional elevation view through the cable of the embodiment of FIG. 1 taken at lines 8—8.

FIG. 1, balloon luminary 2 comprises a balloon 4 inflated by a pressurized gas 6, a lamp 8 in the interior 10 of the balloon 4, and a conductor cable 12 connecting the lamp 8 to a connector 14. The balloon 4 is conventional arid has a reduced dimension gas inlet port 16 at balloon neck portion 18. A ribbon 20 is knotted about the neck portion 18 to close the port 16.

Connector 14 is a conventional plug type connector which mates with a conventional socket 22 in base 24. When connected to the socket 22, the conductor cable 12 tethers the floating helium filled balloon 4 to the base 24. The conductor cable 12 is made of sufficiently small gauge such that its weight does riot interfere with the floatation of the balloon 4. For example, the cable may comprise 30 gauge insulated wires.

The socket is connected to a power source such as one or more batteries 26 or an external AC or DC source, via a transformer (not shown), connected to a conventional power source such as 60 Hz 120 volt lines as presently available. An on-off switch 28 turns the lamp 8 on and off.

The balloon 4 may comprise lightweight latex elastomeric membranes as commercially available for 12 inch diameter balloons, for example. Such balloons may be plain solid colors, decorated or pearlized. The balloons are available from the National Latex Products Company, as decorator balloons, premium helium quality, UPC numbers 7506002763 and 7506002752, by way of example. However, any commercially available helium grade toy type or decorator balloons may be used, but typically the balloon will have a diameter of 12" or more and comprise latex membrane material.

The lamp 8 is preferably what is commercially referred to as high intensity lamps, typically employing halogen or krypton gases. However, any typical commercially available incandescent or other lamp may be used. Three types of lamps that are preferred include 2.5 volt standard Christmas tree lights, 300 Ma bulbs employed in mini-flash lamp applications, and 2.5 volt, 430 Ma krypton bulbs used in mini-flash lights.

The wire cable 12, FIG. 8, comprises a pair of independent, mutually insulated copper conductors 30, 32, preferably of 30 gauge as noted above. The wire conductors 30, 32 are encapsulated in coating 34. The encapsulated conductors may be separate or encapsulated in a single in a single insulating layer provided they are insulated from each other. While not critical, it is preferred that coating 34 comprises an insulating material that is commercially available known as Kynar, a registered trademark of Elf Atochem for a polyvinylidene fluoride (PVDF), which is a thermoplastic semi-crystalline polymer containing approximately 59% fluorine.

The Kynar coating comprises an engineered polymer with some grades containing no additives. This material has the properties of exceptional weather resistance due to its transparency and inertness To ultra-violet light, excellent resistance to most chemicals, thermal stability under operating and processing temperatures and does not darken when heated, good abrasive resistance, enabling its use with slurries, very low creep, high mechanical strength, excellent sterilization resistance, and easy to process. The material has a high dielectric constant which makes it excellent as an electrical conductor insulator.

The Kynar material has very low permeability which is highly desirable for a gas sealant application as employed herein. It has excellent molecular bonding which is excellent as a sealant for sealing the wires 30, 32 to the interior surface of the balloon membrane surface at the neck portion 18.

The smooth surface and coefficient of friction of the Kynar material provides good adherence to the latex material of the balloon 4 neck portion 18 insuring a good positive seal therewith, while preventing the light assembly from slipping under normal operating conditions. This material is non-flammable, non-toxic and usable over a wide temperature range of −40° C. up to 150° C. The material is safe for use with foods and conforms to FDA requirements. Therefore, it is safe to use with toys such as balloons which are typically provided to children.

The material may be extruded, compressed or injection molded. Kynar coated wires are available commercially as illustrated in FIG. 8 and the material is also commercially employed for high temperature wire applications, tank linings because of its good chemical resistance and weathering, tubing, protective paints and coatings, valve and impeller protection, and employed to encapsulate resistors and other electrical components. The present invention is a recognition of the unique properties of the Kynar material for sealing balloons when employed with conductors for luminary balloon applications.

A major concern for helium filled balloons is weight minimization. A balloon constructed in accordance with the present invention can be shown to have buoyancy for 8 hours with minimal weight. For example, a low weight assembly (from the range of components specified) of 0.9 grams would have an estimated duration of 13.2 hours. A heavy weight assembly of 3.8 grams would have an estimated duration of 8.3 hours. Two 18 inch wires are soldered to the leads of the lamp 8 by sweat soldering. Zinc chloride may be used as a solder flux when employing miniature Christmas type lamps. The lamp is inserted into a 12 inch helium quality balloon until it touches the top of the balloon. The balloon is then inflated to full size.

The port 16 may be sealed with a curling ribbon, i.e., a commercially available ribbon which curls when rubbed with an edge due to undulations in the ribbon. Several knots are preferred to insure tight sealing, with the knots on opposite sides of the neck. In FIG. 2, a helium filled balloon luminary 2 is secured to base 24 by the cable 12.

In air filled balloons, weight is not an issue. A support is typically employed. In FIG. 3, the air filled balloon of luminary 36 is supported by a stiff wire 38 about which the cable 12 is inserted into a straw. The wire 38 is mounted to base 40. In FIG. 4, the air filled balloon 41 is supported by a straw 42 about which the cable 12 is wrapped. The straw 42 is mounted to the base 44. In this case a sealing clip 46 may be used to clamp the balloon port 16 at neck 18 closed. The neck may also be wrapped about the clip.

In all cases, the cable 12 is passed through the port 16 and neck 18 with the Kynar material forming an excellent gas tight seal with the balloon membrane. A conical support 48, FIG. 3, may also be used to support the balloon, the clip 46 and support 48 also being commercially available. Preferably, the cable 12 is connected to a 3 volt power source.

The advantage of the curling ribbon is that it seals the neck without kinking the light and cable assembly. Cutting the ribbon permits reuse of the light and wire assembly. This is lightweight and suitable for helium balloons.

By knotting the neck, no other materials are required. However, the cable 12 makes such knotting more difficult. Once knotted, the light and cable assembly are not generally reusable. A sealing washer is preferred because it is easy to use, a fixture is available to hold the balloon during sealing and the light and cable are reusable.

A conical support is useful with air filled balloons and it is easy to support the balloon with a straw or wire. The added weight is not preferred for helium filled balloons as this shortens the floatation duration.

It can be shown that the helium filled balloon with or without wires maintains buoyancy similarly for at least about 8 hours. This is unexpected in view of the presence of the wires in the neck which normally would be expected to reduce the sealing effect of any knot or clip at the neck.

It can be shown that air filled balloons can maintain their inflated dimensions for over 60 hours and, therefore, are preferable for multiple day uses. Tests show that air filled balloons leak down at a rate 17 times better than helium balloons. The added weight of the wires and lamp shortens the buoyancy of helium filled balloons so that they are typically useful for one day.

In FIGS. 5 and 6, an alternative power source 50 is shown comprising a typical flashlight housing 52, a switch 54, a battery(s) 56, a ground connection spring 58 and an active positive power level connection 60. Sliding the switch 54 in directions 62 opens and closes the contacts between the source 50 cable 64 positive terminal at conductor 66 and the ground conductor 68 connected to the spring 58. The cable 64 has a socket 70 for connection to the plug connector 14 on the luminary cable 12, FIG. 1.

In FIG. 7, to protect the balloon from direct contact by the lamp 70, a cage 72 is provided about the lamp. The cage 72 comprises a plurality of elongated members 74 such as plastic extrusions surrounding the lamp. The cage 72 includes a central flange 76 with an aperture for attachment to the end of the cable 12'. The cage prevents the lamp 70 from directly bumping against the inner surface of the balloon. Should the bulb become hot, this will prevent damage to the balloon by excessive local heat.

The cage may take other forms such as a transparent bulb-like unit it desired or any other arrangement for permitting the light from the lamp to be externally visible without detraction or attenuation by the cage. For lamps that do not get hot enough to damage the balloon, he cage may be omitted.

It will occur to one of ordinary skill that various modifications may be made to the disclosed embodiments without departing from the scope of the invention as defined in the appended claims.

What is claimed is:

1. A balloon luminary comprising:

an elastomeric inflatable light translucent membrane having a narrowed neck portion serving as a pressurized gas inlet port, said membrane forming an inflated balloon in response to pressurized gas applied to the membrane through said port into the balloon interior;

a lamp within the balloon interior;

electrical power means comprising a conductor passing directly through said port and directly contactable therewith and connected to said lamp for illuminating the lamp; said conductor comprising a pair of metal wires coated with an insulating coating for electrically isolating the two wires, the surface of said insulate coating having a sufficient coefficient of friction with and adhesivity to, said membrane, upon closing said port, to seal the port and prevent slippage of said wire, during normal operation, and means for closing the port for entrapping the pressurized gas in said interior.

2. The luminary of claim 1 wherein the insulating coating comprises thermoplastic polyvinylidene fluoride (PVDF) containing a semi-crystalline polymer.

3. The luminary of claim 1 wherein the means for closing the port comprises a ribbon tied about the port.

4. The luminary of claim 1 wherein the means for closing the port includes typing the membrane and conductor passing through the port into a knot about the port.

5. The luminary of claim 1 further including a base external to the balloon and an elongated support attached to base and to the balloon at said port.

6. The luminary of claim 5 wherein the means for illuminating includes an electrical power source in said base selectively coupled to the lamp via said conductor passing through the port.

7. The luminary of claim 5 wherein the support includes a straw connected to a cone, for receiving the balloon at said port.

8. The luminary of claim 1 wherein the gas is selected from the group consisting of air and helium.

9. The luminary of claim 5 wherein the elongated support is said electrical conductor connected to said lamp and the power means comprises a power source in said base connected to the conductor.

10. The luminary of claim 9 further comprising a switch means in the base for selectively illuminating said lamp.

11. The luminary of claim 1 wherein said electrical power means comprises a conductor having opposing ends and ohmically connected at one end to the lamp, a portable hand held housing for receiving at least one battery and connected to a second end of the conductor, and switch means coupled to the housing for coupling the battery to the conductor second end.

12. The luminary of claim 1 further comprising a shield proximate to and surrounding at least part of the lamp for spacing the lamp from said membrane.

13. The luminary of claim 12 wherein said shield comprises a light transmissive structure.

14. The luminary of claim 12 wherein said shield comprises a cage.

15. The luminary of claim 1 wherein said lamp comprises halogen or krypton.

16. A balloon luminary comprising:

an elastomeric inflatable light translucent membrane having a pressurizable gas inlet port of a small diameter relative to the balloon for forming a neck on the balloon, said membrane forming an inflated balloon in response to pressurized gas applied to the membrane through said port into the balloon interior;

an electrical conductor passing directly through said port, being directly contactable with the membrane portion of said port and connected ohmically to the lamp;

means for closing the port for entrapping the pressurized gas in said interior; comprising an insulating coating on said conductor engaged in direct contact with the membrane for fluid sealing the conductor to said membrane;

a lamp within the globe interior;

electrical power means coupled to the conductor for illuminating the lamp.

17. The luminary of claim 16 wherein the coating comprises a layer of an adherent polyvinylidene fluoride (PVDF) containing a semi-crystalline polymer.

* * * * *